US011669027B2

(12) United States Patent
Karube et al.

(10) Patent No.: US 11,669,027 B2
(45) Date of Patent: Jun. 6, 2023

(54) ELECTROPHOTOGRAPHIC BELT, METHOD FOR PRODUCING THE SAME, AND ELECTROPHOTOGRAPHIC IMAGE FORMING APPARATUS

(71) Applicant: CANON KABUSHIKI KAISHA, Tokyo (JP)

(72) Inventors: Keiji Karube, Ibaraki (JP); Keisuke Abe, Kanagawa (JP); Masahiro Takenaga, Kanagawa (JP); Kenji Onuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/929,202

(22) Filed: Sep. 1, 2022

(65) Prior Publication Data

US 2023/0081479 A1 Mar. 16, 2023

(30) Foreign Application Priority Data

Sep. 3, 2021 (JP) ..... JP2021-144362

(51) Int. Cl.
*G03G 15/16* (2006.01)

(52) U.S. Cl.
CPC ..... *G03G 15/162* (2013.01); *G03G 15/1605* (2013.01); *G03G 2215/1623* (2013.01)

(58) Field of Classification Search
CPC ..... G03G 15/1605; G03G 15/162; G03G 2215/1623
See application file for complete search history.

(56) References Cited

U.S. PATENT DOCUMENTS

2013/0149540 A1* 6/2013 Sato ..... B05D 3/12 399/302
2014/0377695 A1 12/2014 Kameyama et al.
2015/0323888 A1* 11/2015 Sakamoto ..... G03G 15/162 399/302
2019/0004454 A1 1/2019 Karube
2021/0341859 A1* 11/2021 Kameyama ..... G03G 15/1685
2022/0206419 A1 6/2022 Muramatsu et al.
2022/0206421 A1 6/2022 Miyauchi et al.

FOREIGN PATENT DOCUMENTS

JP 2013231964 A 11/2013
JP 2020122927 A 8/2020
JP 2020160160 A 10/2020

* cited by examiner

*Primary Examiner* — Joseph S Wong
(74) *Attorney, Agent, or Firm* — Canon U.S.A., Inc., IP Division

(57) ABSTRACT

An electrophotographic belt including at least a base layer and a surface layer on or above the base layer, the surface layer including a binder resin and perfluoropolyether (PFPE), having a thickness of 2 μm or more. PFPE is removed to obtain a PFPE-removed surface layer, the PFPE-removed surface layer has pores having openings at an outer surface thereof. When assuming that the PFPE-removed surface layer is a solid-surface layer, a ratio of a total volume of the pores contained in the PFPE-removed surface layer to a volume of the solid-surface layer is 8 to 25%. A ratio of a sum of areas of the openings to a unit area (1 $\mu m^2$) of the outer surface of the PFPE-removed surface layer is 10 to 35%, and the number of the openings per unit area (1 $\mu m^2$) of the outer surface of the PFPE-removed surface layer is 10 to 500.

16 Claims, 2 Drawing Sheets

ELECTROPHOTOGRAPHIC BELT, METHOD FOR PRODUCING THE SAME, AND ELECTROPHOTOGRAPHIC IMAGE FORMING APPARATUS

PRIORITY AND INCORPORATION BY REFERENCE

This application claims the benefit of Japanese Patent Application No. 2021-144362, filed Sep. 3, 2021, which is hereby incorporated by reference herein in its entirety.

BACKGROUND

Technical Field

The present disclosure relates to an electrophotographic belt which can be used as an intermediate transfer belt or the like in an electrophotographic image forming apparatus (hereinafter, also referred to as "electrophotographic apparatus") such as a copying machine and a printer; a method for producing the same; and an electrophotographic image forming apparatus.

Description of the Related Art

In an electrophotographic image forming apparatus, a tandem system is widely adopted which provides a full-color image by superimposing toner images of respective colors of YMCK on an intermediate transfer belt, and then collectively transferring the resultant onto paper.

The intermediate transfer belt to be used here is generally a semiconductive belt, and a belt formed by dispersing carbon black in a resin such as polyimide or polyamide-imide is known as a typical example.

Under such circumstances, in the electrophotographic apparatus which is required to have a high speed and high durability, it is required to further improve transfer characteristics of the intermediate transfer belt. As one example, an effort is carried out to improve transfer characteristics by subjecting the surface of an intermediate transfer belt to various treatments. In Japanese Patent Application Laid-Open No. 2013-231964, there is proposed an intermediate transfer belt which enhances transfer efficiency by coating a surface of an intermediate transfer body with a fluorine compound containing perfluoropolyether having water repellency and oil repellency, in order to reduce an adhesive force of the developer to the surface.

However, in the intermediate transfer body of which the surface is coated with the fluorine compound containing perfluoropolyether, the fluorine compound existing on the surface of the intermediate transfer body is gradually removed by rubbing with a cleaning blade or paper, or the like, over a long period of time. As a result, there has been a case where the releasability of the toner image from the intermediate transfer belt in the secondary transfer step gradually decreases, and the secondary transfer efficiency decreases. A decrease in the secondary transfer efficiency can cause a decrease in a quality of an electrophotographic image.

SUMMARY

At least one aspect of the present disclosure is directed to providing: an electrophotographic belt that maintains a favorable secondary transfer efficiency even after long-term use, and contributes to formation of a high-quality electrophotographic image; and a method for producing the same. In addition, another aspect of the present disclosure is directed to providing an electrophotographic image forming apparatus that can stably form the high-quality electrophotographic image.

According to at least one aspect of the present disclosure, there is provided an electrophotographic belt having at least a base layer and a surface layer on or above the base layer. The surface layer includes a binder resin and perfluoropolyether (PFPE) and having a thickness of 2 μm or more. When removing the PFPE from the surface layer to obtain a PFPE-removed surface layer, the PFPE-removed surface layer has pores having openings at an outer surface of the PFPE-removed surface layer. When assuming that the PFPE-removed surface layer is a solid-surface layer; a ratio of a total volume of the pores contained in the PFPE-removed surface layer to a volume of the solid-surface layer, i.e. pore volume fraction, is 8 to 25%. Further, a ratio of a sum of areas of the openings to a unit area (1 $\mu m^2$) of the outer surface of the PFPE-removed surface layer is 10 to 35%, and the number of the openings per unit area (1 $\mu m^2$) of the outer surface of the PFPE-removed surface layer is 10 to 500.

According to at least another aspect of the present disclosure, there is provided an electrophotographic apparatus having the above electrophotographic belt as an intermediate transfer belt. According to at least one aspect of the present disclosure, there is provided a method for producing the above electrophotographic belt, including: mixing the PFPE, a polymerizable monomer for forming the binder resin, a fluorine-containing copolymer, and a polymerization initiator, to thereby provide a mixture; forming a layer of the mixture on the base layer; and polymerizing the polymerizable monomer in the layer of the mixture to form the surface layer.

Further features of the present disclosure will become apparent from the following description of exemplary embodiments with reference to the attached drawings.

DESCRIPTION

Figure 1:
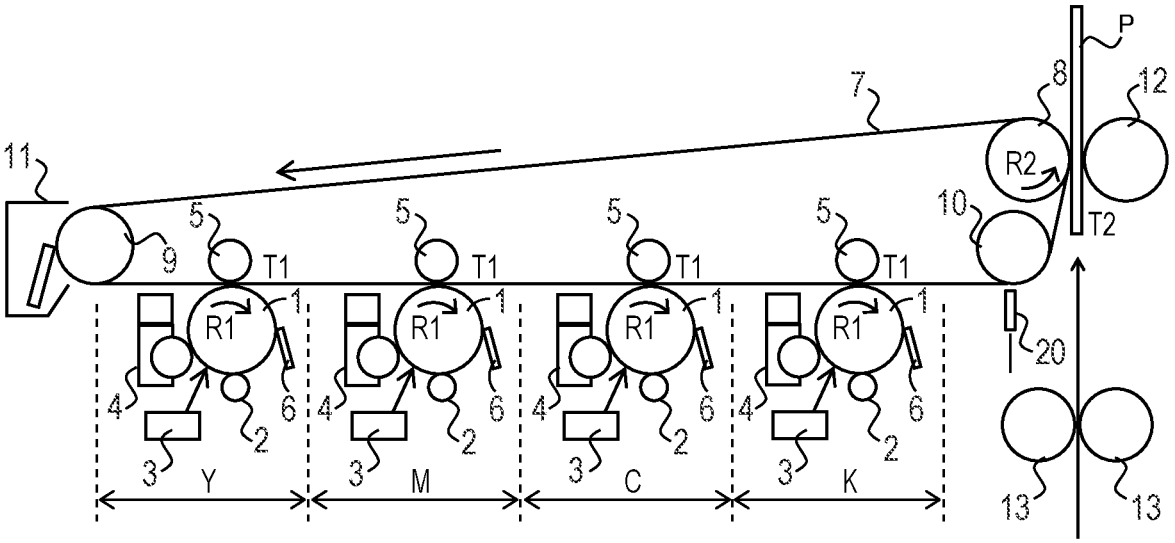
FIG. 1 illustrates a cross-sectional view illustrating one example of an electrophotographic apparatus which uses an intermediate transfer belt according to at least one embodiment of the present disclosure.

In the present specification, the description of "XX or more and YY or less" and "XX to YY" representing a numerical range means a numerical range that includes the lower limit and the upper limit which are endpoints, unless otherwise specified. In addition, when numerical ranges are described in a stepped manner, the above description discloses any combination of the upper limit and the lower limit of each numerical range.

Embodiments according to the present disclosure will be described below in detail with reference to the drawings. However, the dimensions, materials, shapes, relative arrangements and the like of the constituent components described in the following embodiments should be appropriately changed according to the configuration and various conditions of an apparatus to which the present disclosure is applied, and the scope of the present disclosure is not intended to be limited to the following embodiments. According to the results of an image output test conducted by the present inventors, the intermediate transfer body according to Japanese Patent Application Laid-Open No. 2013-231964 provided a favorable image quality at the initial stage of printing, but in the case where the printing has been subsequently continued, transfer characteristics of the intermediate transfer body has gradually changed and the change in the transfer characteristics may result in change in image quality.

Here, the intermediate transfer belt according to Japanese Patent Application Laid-Open No. 2013-231964 was subjected to image formation over a long period of time, and then, the surface was measured with X-ray photoelectron spectrometry (XPS); and as a result, the amount of the fluorine compound which existed at the initial period was reduced to one third or less after the printing of 100 K (100000) sheets. In addition, the intermediate transfer belt according to Japanese Patent Application Laid-Open No. 2013-231964 was subjected to the image formation over a long period of time, and then, a contact angle on the surface with n-hexadecane (hereinafter, also referred to as "hexadecane contact angle") was measured; and as a result, though the initial angle was 50° or more, but the angle was 30° or smaller after the printing of 100 K sheets. From these experimental results, it is assumed that the change in the transfer characteristics observed in the intermediate transfer body according to Japanese Patent Application Laid-Open No. 2013-231964 is caused by disappearance of the fluorine compound which was coated on the surface of the intermediate transfer body, from the surface of the intermediate transfer body due to rubbing with paper or a cleaning blade.

Then, the present inventors have conducted extensive studies to obtain an intermediate transfer belt that can give favorable images over a long period of time. As a result, it has been found that the belt for electrophotography according to the present disclosure, which will be described below, can maintain the hexadecane contact angle of 50° or more even after the printing of, for example, 100 K sheets, and contributes to the formation of favorable electrophotographic images over a long period of time.

A belt for electrophotography according to at least one aspect of the present disclosure has at least a base layer and a surface layer on or above the base layer. The surface layer contains a binder resin and a perfluoropolyether (hereinafter also referred to as "PFPE"). The thickness of the surface layer is 2 μm or more.

In addition, the PFPE exists as domains in the surface layer, and the domains form a structure in which the domains are three dimensionally connected to each other. In addition, the domain communicates with the outer surface of the surface layer. Here, the outer surface of the surface layer is defined as a surface which forms an interface with the atmosphere. In addition, in a surface layer which is obtained by extracting and removing the PFPE from the surface layer (hereinafter also referred to as "PFPE-removed surface layer"), portions at which the PFPE has existed exist as pores that are opened to the outer surface. Then, assuming that the PFPE-removed surface layer is a solid-surface layer, the ratio of the total volume of the pores contained in the PFPE-removed surface layer to a volume of the assumed solid-surface layer is 8 to 25%. Hereinafter, the ratio of the total volume of the pores contained in the PFPE-removed surface layer to a volume of the assumed solid-surface layer may be referred to as "pore volume fraction". In addition, the ratio of the sum of the areas of the openings to a unit area (1 $\mu m^2$) of the outer surface of the PFPE-removed surface layer (hereinafter also referred to as "opening area ratio") is 10 to 35%. Furthermore, the number of the openings per unit area (1 $\mu m^2$) of the outer surface of the PFPE-removed surface layer is 10 to 500.

Outline and Operation of Image Forming Apparatus

FIG. 1 illustrates a schematic cross-sectional view of an image forming apparatus according to at least the present embodiment.

As is illustrated in FIG. 1, in the exemplary image forming apparatus, four process units that serve as image forming units are provided, each of which includes a charging unit, an exposure unit, a developing unit, a cleaner and the like, around a photosensitive drum that serves as an image carrying body. In addition, the images on the photosensitive drums formed in the respective process units are sequentially multiply-transferred to the intermediate transfer belt which moves and passes while abutting on the photosensitive drums, at a plurality of primary transfer nip portions T1, and a full-color toner image is formed. After that, the toner image formed on the intermediate transfer belt is collectively transferred onto a recording material P in a secondary transfer nip portion T2. The toner image on the recording material is configured to be then melted and fixed onto the recording material by heat or pressure, in an unillustrated fixing portion.

The electrophotographic apparatus in at least the present embodiment will be described below in detail.

The exemplary electrophotographic apparatus includes four image forming units of Y (yellow), M (magenta), C (cyan), and K (black) which are installed in parallel in order of first to fourth from left to right in the figure.

Any of the image forming units Y, M, C and K is a laser scanning exposure type of electrophotographic process mechanism and has the same structure; and includes a drum-shaped electrophotographic photosensitive member (hereinafter referred to as drum) 1 serving as the image carrying body. In addition, each of the image forming unit includes a charging roller 2 serving as a charging unit, an exposure apparatus 3 serving as an exposure unit, a developing apparatus 4 serving as a developing unit, a primary transfer roller 5 serving as a primary transfer unit, a drum cleaner 6 and the like, which are all electrophotographic process units acting on the drum 1.

An intermediate transfer belt 7 is stretched between three parallel rollers including a driving and secondary transfer counter roller 8, a tension and deviation correction roller 9, and a driven roller 10. The tension and deviation correction roller 9 is installed on a side of the first image forming unit Y, the driving and secondary transfer counter roller 8 is installed on a side of the fourth image forming unit K, and the driven roller 10 is installed below the driving and secondary transfer roller 8. The lower surface of the intermediate transfer belt between the tension and deviation correction roller 9 and the driven roller 10 is brought into contact with the upper surfaces of the respective drums 1 of the image forming units Y, M, C and K. In addition, the tension and deviation correction roller 9 is structured so as to be capable of controlling the deviation of the intermediate transfer belt by adjusting the alignment.

The primary transfer rollers 5 of the respective image forming units Y, M, C and K are installed in the inside of the intermediate transfer belt between the tension and deviation correction roller 9 and the driven roller 10, and are structured to be pressed against the upper surface of the drums 1, respectively, while sandwiching the intermediate transfer belt 7. Contact portions between the drums 1 of the respective image forming units Y, M, C and K and the intermediate transfer belt 7 are primary transfer nip portions T1, respectively. A contact portion between the intermediate transfer belt 7 and the secondary transfer roller 12 is a secondary transfer nip portion T2.

A registration roller pair 13 is installed on an upstream side of the secondary transfer nip portion T2 in the conveyance direction of the recording material. In addition, an unillustrated recording material conveying belt apparatus and a fixing apparatus are sequentially installed on a downstream side of the secondary transfer nip portion T2 in the conveyance direction of the recording material.

An operation for forming a full-color image is as follows. The first to fourth image forming units Y, M, C and K are driven at the respective predetermined control timings of an image forming sequence. By this driving, each drum 1 is rotationally driven in the direction of the arrow R1 (clockwise direction) at the same predetermined speed. Then, the intermediate transfer belt 7 is also rotated by the driving and secondary transfer counter roller 8 in the direction indicated by the arrow R2 (counterclockwise direction) at the same speed as the rotation speed of the drum 1.

The surface of the rotating drum 1 is uniformly charged to a predetermined polarity and potential by the charging roller 2.

The charged surface of the drum 1 is image-exposed by the exposure apparatus 3. In at least the present embodiment, the exposure apparatus 3 is a laser scanner; and outputs laser light modulated in response to an image information signal, and scans and exposes the charged surface of the drum 1. Thereby, an electrostatic image (electrostatic latent image) corresponding to the scanning exposure pattern is formed on the drum surface. The formed electrostatic image is developed as a toner image by the developing apparatus 4.

Through the exemplary electrophotographic process as described above, in the first image forming unit Y, a yellow toner image corresponding to the yellow component image among the color separation component images of the full-color original image is formed on the surface of the drum 1. In the second image forming unit M, a magenta toner image corresponding to the magenta component image is formed, and in the third image forming unit C, a cyan toner image corresponding to the cyan component image is formed at the respective predetermined control timings. In addition, in the fourth image forming portion K, a black toner image corresponding to the black component image is formed at the predetermined control timing.

Then, at the primary transfer nip portion T1 of the first image forming unit Y, the yellow toner image formed on the drum 1 is primarily transferred onto the intermediate transfer belt 7 which is being rotationally driven. Next, at the primary transfer nip portion T1 of the second image forming unit M, the magenta toner image formed on the drum 1 is superimposed on and primarily transferred onto the above yellow toner image on the intermediate transfer belt 7. Furthermore, at each of the primary transfer nip portions T1 of the third image forming unit C and the fourth image forming unit K, a cyan toner image and a black toner image are sequentially primarily transferred onto the intermediate transfer belt 7, in the same way.

In other words, four color toner images of yellow, magenta, cyan and black are sequentially superimposed (multiplexed) on and transferred onto the intermediate transfer belt 7 in a predetermined way, and a full-color unfixed toner image is compositely formed. In each primary transfer nip portion T1, a predetermined primary transfer bias is applied to the primary transfer roller 5 from an unillustrated primary transfer power supply portion, and the toner image is electrostatically transferred (primarily transferred) from the drum 1 to the intermediate transfer belt 7.

The primary transfer bias is a DC voltage which has a polarity opposite to the charged polarity of the toner and has a predetermined potential. In addition, in each of the image forming portions Y, M, C and K, the surface of the drum 1 after having passed through the primary transfer nip portion is subjected to removal of primary transfer residual toner by a drum cleaner 6, is thereby cleaned, and is repeatedly subjected to an image forming process.

The unfixed toner image of the full-color image which has been compositely formed on the intermediate transfer belt 7 in the above way is conveyed by the subsequent rotation of the intermediate transfer belt 7, and reaches the secondary transfer nip portion T2 which is a contact portion between the secondary transfer roller 12 and the intermediate transfer belt 7. Then, the start of rotation of the registration roller pair 13 is controlled so that the print start position of the recording material P coincides with the secondary transfer nip portion T2, at the timing when the leading edge of the full-color unfixed toner image which has been formed on the intermediate transfer belt 7 reaches the secondary transfer nip portion T2. In an exemplary process in which the recording material P is sandwiched and conveyed at the secondary transfer nip portion T2, a secondary transfer bias is applied to the secondary transfer roller 12, which has a polarity opposite to the charged polarity of the toner and has a predetermined potential, from an unillustrated secondary transfer power supply portion. The secondary transfer bias is a DC voltage which has the polarity opposite to the charged polarity of the toner and has the predetermined potential.

Thereby, the unfixed full-color toner image on the intermediate transfer belt 7 is collectively secondarily transferred onto the recording material P. The recording material P that has exited from the secondary transfer nip portion T2 is separated from the intermediate transfer belt 7, and is introduced into the fixing apparatus by the recording material conveying belt apparatus. Then, the toners of the respective color toner images are melted and mixed, and are fixed (fixed image formation) on the surface of the recording material as a full-color print image; and the full-color print is discharged to the outside of the apparatus.

The surface of the intermediate transfer belt 7 after having been separated from the recording material is cleaned due to the removal of the secondary transfer residual toner by the intermediate transfer belt cleaner 11 in the subsequent rotation process of the intermediate transfer belt 7, and is prepared for the next image forming process. The intermediate transfer belt cleaner 11 is structured so as to bring a cleaning blade into contact with the surface of the belt 7 therein, scrape off the secondary transfer residual toner which adheres to the belt surface, and collect the secondary transfer residual toner as collected toner, into a collected toner box in the intermediate transfer belt cleaner 11.

A patch detection sensor 20 (toner image detection unit) having a function of detecting an image density is provided at a position facing a portion at which the stretching roller 10 stretches the intermediate transfer belt. The patch detection sensor 20 is a sensor which optically detects reflected light or scattered light of light that has been emitted to the toner image for adjustment (patch image) after having been formed on the intermediate transfer belt and before being secondarily transferred from the intermediate transfer belt to the recording material.

An image forming condition is adjusted according to a detection result of the patch detection sensor 20.

Here, in order to more stably and accurately measure the density for controlling the image forming conditions, it is necessary that the intensity of the reflected light from the surface of the intermediate transfer belt is a certain level or higher. Otherwise, the density cannot be detected accurately, and there is a case where density unevenness among each image results in being large.

Electrophotographic Belt

<Base Layer>

Figure 2:
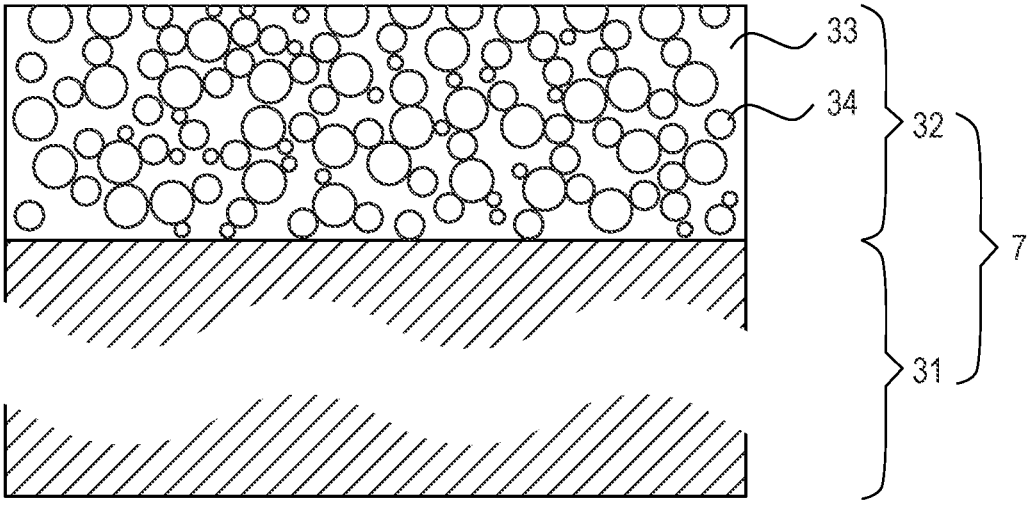
FIG. 2 illustrates a view schematically illustrating a cross section of an intermediate transfer belt according to at least one embodiment of the present disclosure.

As is illustrated in FIG. 2, the electrophotographic belt 7 according to at least one aspect of the present disclosure includes two layers of a base layer 31 and a surface layer 32 provided on an outer peripheral surface of the base layer 31. The surface layer 32 includes a binder resin 33 and a domain 34 that contains PFPE as a main component.

As a material constituting the base layer 31, resins can be used which have mechanical strength and bending resistance needed as the electrophotographic belt. Specific examples thereof include, but are not limited to, the following: polyamide, polyacetal, polyarylate, polycarbonate, polyphenylene ether, polyethylene terephthalate, polyethylene naphthalate, polybutylene naphthalate, polysulfone, polyether sulfone, polyphenyl sulfide, polybutylene terephthalate, polyether ether ketone, polyvinylidene fluoride, polyvinyl fluoride, polyether amide copolymer, polyurethane copolymer, polyimide and polyamide-imide. The base layer can be formed from at least one resin selected from the groups consisting of the above-mentioned resins and the combination of two or more of the above-mentioned resins. Further, an electroconductive substance can be contained in the base layer in order to impart electroconductivity thereto.

As the electroconductive substance, electroconductive particles are used that include, but are not limited to: carbon-based inorganic electroconductive particles such as carbon black, a carbon fiber and a carbon nanotube; and metal-oxide particles such as a zinc-antimonate particle, a zinc-oxide particle, a tin-oxide particle, and a titanium-oxide particle. The volume resistivity of the base layer can be adjusted to a range of $10^8$ to $10^{12}$ [Ω●cm], by a blend of such an electroconductive substance. In addition, the surface resistivity of the base layer can be adjusted to a range of $10^8$ to $10^{14}$ [Ω/sq.].

Due to the volume resistivity being set within the above range, a primary transferability or a secondary transferability by the application of the predetermined transfer bias can be further improved. In addition, due to the surface resistivity of the base layer being set within the above range, separation discharge and toner scattering upon separation of the transfer material from the intermediate transfer belt can be suppressed more reliably. The thickness of the base layer 31 can be 40 to 200 μm, in order to obtain an excellent mechanical strength and bending resistance.

In addition, in at least one embodiment, the electrophotographic belt after the surface layer has been formed on the base layer also shows a similar electric resistance value. Because of this, the surface layer can also have semiconductivity. Specifically, the volume resistivity of the electrophotographic belt can be adjusted to a range of $10^8$ to $10^{12}$ [Ω●cm]. In addition, the surface resistivity can be adjusted to a range of $10^8$ to $10^{14}$ [Ω/sq.]. In order to adjust the volume resistivity and surface resistivity of the intermediate transfer belt, the surface layer can contain an electroconductive agent. As the electroconductive agent to be contained in the surface layer, the same electroconductive agents (electroconductive substances) as those which can be used in the above base layer can be used.

<Surface Layer>

The surface layer 32 includes a binder resin and perfluoropolyether (PFPE), and can further include a dispersing agent, a photopolymerization initiator and an electroconductive substance.

<Interconnecting Structure>

In the surface layer 32, the binder resin and the domain that contains the PFPE as a main component are phase-separated, and the domains form a three dimensionally interconnected structure on the surface and in the inside of the film.

Generally, even in the case where the phases are separated, the mutual component compositions are not precise. Even in the case where the phases having a clear interface are separated, each phase may mutually contain a trace amount of a component of another phase. In addition, it is scientifically said that an intermediate composition exists in a very narrow width of about 10 nm, at the interface. In the present disclosure, a state of a structure in which the domains are connected to each other can be grasped, by operations of: cutting out a sample from the surface layer; extracting the PFPE contained in the sample; and then observing each of a surface corresponding to the outer surface of the surface layer 32 of the belt for electrophotography, and a surface corresponding to a cross-section in the thickness direction of the sample, with a scanning electron microscope (SEM). Specifically, by confirming the existence of a pore which opens on a surface corresponding to the outer surface of the surface layer and extends from the surface in the direction of the thickness of the surface layer in the PFPE-removed sample, it can be confirmed that the domains containing the PFPE exist in the surface layer in a state of being three dimensionally connected to each other. For information, a method for removing (extracting) the PFPE from the surface layer containing the PFPE will be described later.

It can be checked whether the domain contains the PFPE as a main component, by observing a fragment of a fluorocarbon ether structure which is derived from the PFPE, from the domain, with energy dispersive X-ray analysis (EDX) or TOF-SIMS. Here, the necessity of the interconnection structure will be described.

PFPE has a very small surface free energy. Because of this, the PFPE contained in the surface layer 32 of the belt for electrophotography can reduce an adhesive force between the surface of the surface layer 32 and the toner. However, when each of the domains of the PFPE is isolated in the surface layer, it is difficult for PFPE existing in the inside of the surface layer to migrate to the surface of the surface layer. Because of this, when the PFPE which exists in the vicinity of the outer surface of the surface layer at the initial stage has disappeared due to rubbing with paper, new PFPE which exists in the inside of the surface is not sufficiently supplied to the vicinity of the outer surface, and it becomes difficult to maintain favorable secondary transfer characteristics.

On the other hand, when the domains form an interconnected structure in which the domains are three dimensionally interconnected, the domains are connected to each other, and accordingly when the PFPE on the outer surface has disappeared, the PFPE existing in the inside of the surface layer can easily migrate to the outer surface. Because of this, the PFPE can be supplied to the outer surface stably over a long period of time, and favorable secondary transfer characteristics can be maintained over a longer period of time.

The domain can be substantially composed of the PFPE, but chemical species other than the PFPE may exist in the domain in addition to the PFPE as long as the effect of the present disclosure is exhibited, and an additive compatible with the PFPE may be added for the purpose of adjusting other properties. Furthermore, even when the domains are not completely filled with the PFPE and pores exist, the effects of the present disclosure can be exhibited.

<Binder Resin>

As a binder resin of the present disclosure, a methacrylic resin or an acrylic resin can be used in order to disperse PFPE, ensure an adhesion between the base layer 31 and the surface layer 32, and ensure characteristics of the mechanical strength. Hereinafter, the methacrylic resin and the acrylic resin are collectively referred to as an acrylic resin.

Examples of a polymerizable monomer for forming the acrylic resin include the following (I) and (II). A polymerizable monomer which is marketed as a paint can also be used.

(I) At least one acrylate selected from the group consisting of pentaerythritol triacrylate, pentaerythritol tetraacrylate, ditrimethylolpropane tetraacrylate, dipentaerythritol hexaacrylate, an alkyl acrylate, benzyl acrylate, phenyl acrylate, ethylene glycol diacrylate, and bisphenol A diacrylate.

(II) At least one methacrylate selected from the group consisting of pentaerythritol trimethacrylate, pentaerythritol tetramethacrylate, ditrimethylolpropane tetramethacrylate, dipentaerythritol hexamethacrylate, an alkyl methacrylate, benzyl methacrylate, phenyl methacrylate, ethylene glycol dimethacrylate, and bisphenol A dimethacrylate.

Among the polymerizable monomers, the monomer can have a high hardness in consideration of rubbing with other members such as a photosensitive member and a cleaning blade. Because of this, also for the acrylic resin, a large amount of cross-linkable monomers having two or more functional groups can be used, and thereby impart a higher hardness.

In addition, in order to form an acrylic resin from such a polymerizable monomer, a method may be employed involving adding a photopolymerization initiator followed by polymerization with energy ray such as an electron beam or an ultraviolet ray.

Examples of the photopolymerization initiator include the following: radical generating type of photopolymerization initiators such as benzophenone, thioxanthone-based, benzyl dimethyl ketal, α-hydroxy ketone, an α-hydroxyalkylphenone, α-aminoketone, an α-aminoalkylphenone, monoacylphosphine oxide, bisacylphosphine oxide, hydroxybenzophenone, aminobenzophenone, titanocene-based, oxime ester, and oxyphenylacetic acid ester.

<PFPE>

Next, in the present disclosure, PFPE refers to an oligomer or polymer having perfluoroalkylene ether as a repeating unit.

Examples of the repeating unit of perfluoroalkylene ether include repeating units of perfluoromethylene ether, perfluoroethylene ether, and perfluoropropylene ether. Specific examples thereof include trade name: Demnum (R) manufactured by Daikin Industries, Ltd., trade name: Krytox (R) manufactured by Dupont Kabushiki Kaisha, and trade name: Fomblin (R) manufactured by Solvay Specialty Polymers Japan K.K.

A weight average molecular weight Mw of the PFPE can be 100 to 20,000, from the viewpoint of the transferability of the PFPE to the surface of the intermediate transfer belt.

The weight average molecular weight referred to herein is a value obtained by measuring a solution obtained by dissolving the PFPE in 1,1,2,2,3,3,4-heptafluorocyclopentane, with a liquid chromatography analysis apparatus (manufactured by Shimadzu Corporation).

Note that 1,1,2,2,3,3,4-heptafluorocyclopentane is commercially available as, for example, ZEORORA (R) H (manufactured by Zeon Corporation).

In addition, the content of the PFPE can be 20 to 40% by mass, based on the mass of the total solid content of the surface layer. When the content is 20% by mass or more, the surface layer can maintain excellent low adhesiveness. In addition, when the content is 40% by mass or less, the surface layer can maintain an excellent film strength. Due to the content of the PFPE being adjusted within the above range, the surface layer of the intermediate transfer belt can supply the PFPE from its inside to the surface of the intermediate transfer belt, and can suppress a decrease in releasability of the surface of the intermediate transfer belt, even in repeated transfer.

In order to form domains which contain the PFPE and are three dimensionally connected to each other, in the surface layer, the viscosity of the PFPE contained in the surface layer can be controlled in a range of 50 to 550 mPa·s, particularly in a range of 50 to 200 mPa·s, and further in a range of 50 to 150 mPa·s. By using the PFPE which is controlled to the viscosity within such a range, the surface layer can more reliably form domains having a three dimensionally interconnected structure therein. In addition, excessive migration of the PFPE to the outer surface of the surface layer can be suppressed, and a belt for electrophotography which can stably maintain high releasability of the toner over a longer period of time can be obtained.

Here, the viscosity of the PFPE is a value obtained by: using a rheometer (trade name: DHR-2; manufactured by TA Instruments Japan Inc.); mounting a cone-plate mold having a cone angle of 1° and a cone radius of 20 mm; and rotating the mold at a measurement temperature of 20° C. and a shear rate of 100 s-1 for 60 seconds.

<Dispersing Agent>

The surface layer of the electrophotographic belt according to at least one aspect of the present disclosure contains a dispersing agent for dispersing the PFPE thereinto. The dispersing agent can be a fluorine-containing copolymer which is obtained by copolymerizing an acrylate or methacrylate having a fluoroalkyl group with a methacrylate macromonomer having polymethyl methacrylate in a side chain.

Examples of such a fluorine-containing copolymer include Aron (R) GF-150, GF300, GF400, GF420 and GF430 manufactured by Toagosei Co., Ltd., and FD-420 and ALX series manufactured by Kyoeisha Chemical Co., Ltd.

In addition, as for the above fluorine-containing copolymer, a weight average molecular weight can be in a range of 15,000 to 80,000, from the viewpoint of being excellent in a dispersion effect on the PFPE and also being excellent in connectivity of the domains.

In such a fluorine-containing copolymer, a fluoroalkyl group attaches to the PFPE. On the other hand, a steric hindrance effect of suppressing agglomeration with other the PFPE acts in a portion derived from an acrylate or a methacrylate, and in a portion having a methacrylate macromonomer having polymethyl methacrylate in a side chain. As a result, it is considered that a dispersion performance for the PFPE can be exhibited.

In addition, due to the weight average molecular weight being within the above range, it is suppressed that the steric hindrance effect becomes excessively high, and accordingly the domains can be connected to each other more reliably in the surface layer.

<Molecular Weight Measurement Method>

The weight average molecular weight of the dispersing agent described above is a value which is measured with the use of a gel permeation chromatography (GPC) apparatus. Specifically, for example, the above dispersing agent is dissolved in tetrahydrofuran, and the solution is used as a sample. An elution time distribution was measured by GPC apparatus in which a sample was injected into a column and is passed through the column at a certain constant flow rate, and components having adsorbed to the column were eluted; and a molecular weight distribution was obtained based on a calibration curve which was prepared in advance by use of a polystyrene standard sample of which the molecular weight was known. From the result, the weight average molecular weight is calculated.

Column: TSK-GEL MULTIPORE HXL-M manufactured by Tosoh Corporation

GPC apparatus: HLC-8220 manufactured by Tosoh Corporation

The content of the above dispersing agent can be be 5 to 30% by mass, or 15 to 25% by mass, based on the mass of the total solid content in the surface layer.

<Electroconductive Agent>

An electroconductive agent can be added, in order to impart electroconductivity to the surface layer. Examples of the electroconductive agent include: carbon-based inorganic electroconductive particles such as carbon black, a carbon fiber and a carbon nanotube; and metal-oxide particles such as a zinc-antimonate particle, a zinc-oxide particle, a tin-oxide particle, and a titanium-oxide particle.

<Method for Producing Electrophotographic Belt>

A specific method for producing an electrophotographic belt according to at least one aspect of the present disclosure will be described below. Note that the present disclosure is not limited to the following production methods.

The base layer 31 of the electrophotographic belt can be produced by the following method.

For example, in the case of a thermosetting resin such as polyimide, carbon black which is the electroconductive agent is dispersed together with a precursor of the thermosetting resin or a soluble thermosetting resin and a solvent which are regarded as a varnish, and the varnish is coated on a mold of a centrifugal molding apparatus. Subsequently, the coated film is subjected to a baking process, and a semiconductive film is formed.

In addition, when a thermoplastic resin is used, carbon black which is the electroconductive agent is mixed with the thermoplastic resin, and if necessary, an additive material; the mixture is melt-kneaded with a twin-screw kneading apparatus or the like; and a semiconductive resin composition is produced. Next, a semiconductive film can be obtained by an extrusion method in which the resin composition is extruded into a form of a sheet, a film or an endless-shaped belt by melt extrusion. Forming methods of the endless-shaped belt includes, for example, a method comprising a step of extrusion of the resin composition from a cylindrical die, and a method comprising a step of joining a sheet made of the resin composition. Further, as a method of forming the sheet and the film, hot pressing method and injection molding can be employed. The film thickness of the semiconductive film which becomes the base layer 31 can be 30 to 150 μm or smaller.

In addition, the intermediate transfer belt can be subjected to crystallization treatment, for the purpose of enhancing the mechanical strength and durability thereof. The crystallization treatment means, for example, annealing treatment at a temperature of the glass transition temperature of the resin to be used or higher, and thereby can promote the crystallization of the resin to be used. The thus obtained intermediate transfer belt is excellent not only in the mechanical strength and durability, but also in abrasion resistance, chemical resistance, slidability, toughness and flame retardancy.

Next, examples of a method of forming the surface layer 32 of the electrophotographic belt according to at least the present aspect include the following method. Firstly, an acrylic monomer for forming a binder resin which is the above described constituent members of the surface layer 32, a polymerization initiator, PFPE, a dispersing agent and an electroconductive agent are dissolved and dispersed in an appropriate organic solvent, thereby providing a mixture for the surface layer. Next, the mixture is applied onto the outer peripheral surface of the base layer 31 by a method such as ring coating, dip coating or spray coating, and is dried at 60 to 90° C. for the purpose of removing the organic solvent, thereby forming a layer of the mixture. After that, for example, the layer of the mixture is heated to a temperature of 40 to 90° C., and the layer of the mixture is irradiated with ultraviolet rays from the outer surface to polymerize the polymerizable monomer in the layer of the mixture and to cure the layer of the mixture, thereby forming a surface layer.

It is preferable that the thickness of the surface layer 32 is 2 to 20 μm. Due to the thickness of the surface layer being within the above range, the surface layer can achieve both of maintenance of excellent secondary transfer performance over a long period of time, and favorable folding endurance needed as an electrophotographic belt, at high levels.

EXAMPLES

Firstly, a method for measuring physical properties related to an electrophotographic belt according to at least one aspect of the present disclosure will be described.

<Extraction of PFPE>

A sample (length: 50 mm, width: 50 mm, thickness: total thickness of surface layer) was cut out from the surface layer of the electrophotographic belt, and was immersed in 200 mL of a fluorine-based solvent (trade name: Asahiklin AE-3000; manufactured by AGC Inc.) which contained 1,1,2,2-tetrafluoroethyl-2,2,2-trifluoroethyl ether and could dissolve the PFPE thereinto; and ultrasonic waves were applied thereto for 10 minutes with the use of an ultrasonic cleaning apparatus. After that, the sample was taken out from the fluorine-based solvent, was left to stand in an environment at a temperature of 25° C. for 24 hours, and was dried.

<Measurement of Pore Volume Fraction after PFPE Extraction>

A mass of the sample after extraction of the PFPE was measured, which was obtained by the above operation. Subsequently, the sample was immersed in the following PFPE oil of which the specific weight is known, and allowed to stand under reduced pressure (100 Pa or lower) for 1 hour; and the PFPE oil was impregnated into the pores.

PFPE oil: Fomblin M03 and Fomblin Y04 (trade name; manufactured by Solvay Specialty Polymers Japan K.K.)

Next, the sample was taken out from the PFPE oil, the PFPE oil was wiped off which adhered to the surface, and the mass was measured. The pore volume was calculated from the difference in mass between before and after impregnation with the PFPE oil, and the pore volume fraction was calculated by dividing the pore volume by a sample volume (length of 50 mm×width of 50 mm×thickness of surface layer).

<Measurement of Area Ratio of Pore Openings and Number of Pore Openings, on Outer Surface of Surface Layer after PFPE Extraction>

A surface corresponding to the outer surface of the surface layer of the sample after extraction of PFPE, which was obtained by the operation was observed with the use of a scanning electron microscope (trade name: FE-SEM 54700; manufactured by Hitachi High-Technologies Corporation), and a SEM image was obtained. Then, the SEM image was firstly converted to 8-bit grayscale and was converted into a monochrome image having 256 gradations, with the use of image processing software (trade name: IMAGEPRO PLUS ver 7. 0, manufactured by Media Cybernetics, Inc.). Next, the monochrome image was subjected to noise removal by a median filter, and removal of luminance gradient and unevenness by smoothing filter processing, and was then subjected to binarization processing by an algorithm known as "Otsu's binarization"; and a binarized image was obtained in which the openings of the pores were recognized as low-brightness portions. The obtained binarized image was subjected to a labeling process in which a number was assigned to each cluster of the low-brightness portion corresponding to the opening, and the number of clusters was measured; and the number per unit area (1 $\mu m^2$) of the surface was calculated. In addition, the ratio (opening area ratio) of a sum of areas of the low-brightness portions to a unit area (1 $\mu m^2$) of the surface was calculated.

<Image Evaluation—Evaluation of Transferability>

The belt for electrophotography was mounted on an electrophotographic image forming apparatus (trade name: Color imageRUNNER (R) iRC2620, manufactured by Canon Inc.), as an intermediate transfer belt thereof.

Electrophotographic images were printed with the use of this electrophotographic image forming apparatus. Here, each of the images was visually evaluated that were an image 1 which was printed immediately after the start of printing, an image 2 which was printed after printing of 200000 sheets (after repeating transfer of 200000 times), and an image 3 which was printed after printing of 600000 sheets (after repeating transfer of 600000 times); and was evaluated according to the following criteria.

Rank A: Deterioration in an image quality due to secondary transfer failure is not observed.

Rank B: The deterioration in the image quality due to the secondary transfer failure is observed. But, an area in which the image quality is deteriorated due to the transfer failure is 20% or smaller of the printing area.

Rank C: The area in which the image quality is deteriorated due to the secondary transfer failure is larger than 20% and 50% or smaller of the printing area.

Rank D: The area in which the image quality is deteriorated due to the secondary transfer failure is larger than 50% of the printing area.

Example 1

Materials shown in the following Table 1 were mixed and dispersed by a stirring type homogenizer (manufactured by AS ONE Corporation), and then a mixed dispersion liquid was obtained with the use of a dispersion apparatus Nanomizer (manufactured by Yoshida Kikai Co., Ltd.).

TABLE 1

| Material | Blending proportion (part by mass) |
|---|---|
| Dipentaerythritol hexaacrylate | 5.0 |
| Pentaerythritol tetraacrylate | 8.0 |
| Pentaerythritol triacrylate | 4.0 |
| 2,2,2-Trifluoroethanol | 26.0 |
| Electroconductive agent (trade name: Celnax CX-Z210IP, manufactured by Nissan Chemical Corporation) | 8.0 |
| Photopolymerization initiator (trade name: Irgacure 184; manufactured by IGM Resins B.V.) | 1.0 |
| PFPE (trade name: Fomblin D2; manufactured by Solvay Specialty Polymers Japan K.K., viscosity at a temperature of 20° C. = 150 mPa · s) | 8.0 |
| Dispersing agent * | 14.8 |

* The dispersing agent was an agent which was prepared by volatilizing a solvent component of "Aron GF-430" (trade name, manufactured by Toagosei Co., Ltd.), and dissolving the product in 2,2,2 trifluoroethanol so that the solid content concentration became 20% by mass.

Subsequently, an intermediate transfer belt was used as the base layer 31 , which was mounted on an electrophotographic image forming apparatus itself (trade name: iRC2620; manufactured by Canon Inc.), had an endless shape and was made of polyimide. Specifically, the mixed dispersion liquid which was prepared in the above was applied onto the outer peripheral surface of the intermediate transfer belt, and was dried at a temperature of 70° C., for 3 minutes. After that, the film was heated to a temperature of 50° C., and simultaneously was cured with ultraviolet rays of 500 mJ/$cm^2$ with the use of an ultraviolet (UV) treatment apparatus (manufactured by Eye Graphics Co., Ltd.); and a surface layer 32 was formed which had a film thickness of 4 μm. In this way, the belt for electrophotography 1 according to the present Example was produced, which had the surface layer 32 on the outer peripheral surface of the base layer 31.

The type of PFPE used, the type of dispersing agent, the molecular weight Mw of the dispersing agent, and a heating temperature at the time of the UV treatment are shown in Table 2. In addition, for the obtained electrophotographic belt 1, the pore volume fraction, the number of openings, and the opening area ratio were determined by the methods. Furthermore, the image evaluation-evaluation of transferability was conducted. The results are shown in Table 3.

Example 2

An electrophotographic belt 2 was obtained by being produced in the same method as in Example 1 except that a dispersing agent was used which was prepared by batching off "FD-420" (trade name; manufactured by Kyoeisha Chemical Co., Ltd.) in place of "Aron GF-430" (trade name; manufactured by Toagosei Co., Ltd.) in Example 1, and adjusting the weight average molecular weight Mw to 79000. Then, the evaluation was conducted in the same method as in Example 1.

Example 3

An electrophotographic belt 3 was obtained by being produced in the same method as in Example 1 except that "Aron GF-420" (trade name; manufactured by Toagosei Co., Ltd.) was used as a dispersing agent in place of "Aron GF-430" (trade name; manufactured by Toagosei Co., Ltd.) in Example 1. Then, the evaluation was conducted in the same method as in Example 1.

Example 4

An electrophotographic belt 4 was obtained by being produced in the same method as in Example 1 except that the heating temperature at the time of the UV treatment was changed from 50° C. to 40° C. in Example 1. Then, the evaluation was conducted in the same method as in Example 1.

Example 5

An electrophotographic belt 5 was obtained by being produced in the same method as in Example 1 except that the heating temperature at the time of the UV treatment was changed from 50° C. to 90° C. in Example 1. Then, the evaluation was conducted in the same method as in Example 1.

Example 6

In Example 1, "Fomblin M03" (trade name: manufactured by Solvay Specialty Polymers Japan K.K.) was used in place of "Fomblin D2" (trade name; manufactured by Solvay Specialty Polymers Japan K.K.), as the PFPE. An electrophotographic belt 6 was obtained by being produced in the same method as in Example 1, except for the point. Then, the evaluation was conducted in the same method as in Example 1.

Example 7

In Example 1, "Fomblin M30" (trade name: manufactured by Solvay Specialty Polymers Japan K.K.) was used in place of "Fomblin D2" (trade name; manufactured by Solvay Specialty Polymers Japan K.K.), as the PFPE. An electrophotographic belt 7 was obtained by being produced in the same method as in Example 1, except for the point. Then, the evaluation was conducted in the same method as in Example 1.

Example 8

An electrophotographic belt 8 was obtained by being produced in the same method as in Example 1 except that the amount of the dispersing agent to be blended was changed from 14.8 parts by mass to 18.5 parts by mass, and the heating temperature at the time of the UV treatment was changed from 50° C. to 40° C., in Example 1. Then, the evaluation was conducted in the same method as in Example 1.

Example 9

An electrophotographic belt 9 was obtained by being produced in the same method as in Example 6 except that the amount of "Fomblin M03" (trade name; manufactured by Solvay Specialty Polymers Japan K.K.) blended as the PFPE was changed from 8 parts by mass to 12 parts by mass, and the heating temperature at the time of the UV treatment was changed from 50° C. to 90° C., in Example 6. Then, the evaluation was conducted in the same method as in Example 1.

Example 10

An electrophotographic belt 10 was obtained by being produced in the same method as in Example 9 except that the film thickness of the surface layer 32 was adjusted so that the film thickness became ½, in Example 9, and the film thickness of the surface layer 32 was changed from 4 μm to 2 μm. Then, the evaluation was conducted in the same method as in Example 1.

Comparative Example 1

An electrophotographic belt 11 was obtained by being produced in the same method as in Example 1 except that "FD-420" (trade name; manufactured by Kyoeisha Chemical Co., Ltd.) was used as the dispersing agent in place of "Aron GF-430" (trade name; manufactured by Toagosei Co., Ltd.), in Example 1. Then, the evaluation was conducted in the same method as in Example 1.

Comparative Example 2

An electrophotographic belt 12 was obtained by being produced in the same method as in Example 1 except that "Fluorolink (R) MD700" (trade name; manufactured by Solvay Specialty Polymers Japan K.K.) was used as the PFPE, in place of "Fomblin D2" (trade name; manufactured by Solvay Specialty Polymers Japan K.K.), and "FD-420" (trade name; manufactured by Kyoeisha Chemical Co., Ltd.) was used as the dispersing agent in place of "Aron GF-430" (trade name; manufactured by Toagosei Co., Ltd.), in Example 1. Then, the evaluation was conducted in the same method as in Example 1.

Comparative Example 3

An electrophotographic belt 13 was obtained by being produced in the same method as in Example 1 except that "Fluorolink MD700" (trade name; manufactured by Solvay Specialty Polymers Japan K.K.) was used as the PFPE, in place of "Fomblin D2" (trade name; manufactured by Solvay Specialty Polymers Japan K.K.), and "Aron GF-400" (trade name; manufactured by Toagosei Co., Ltd.) was used as the dispersing agent, in place of "Aron GF-430" (trade name; manufactured by Toagosei Co., Ltd.), in Example 1. Then, the evaluation was conducted in the same method as in Example 1.

Comparative Example 4

An electrophotographic belt 14 was obtained by being produced in the same method as in Example 1 except that "Fluorolink MD700" (trade name; manufactured by Solvay Specialty Polymers Japan K.K.) was used as the PFPE, in place of "Fomblin D2" (trade name; manufactured by Solvay Specialty Polymers Japan K.K.), and "Aron GF-420" (trade name; manufactured by Toagosei Co., Ltd.) was used as the dispersing agent, in place of "Aron GF-430" (trade name; manufactured by Toagosei Co., Ltd.), in Example 1. Then, the evaluation was conducted in the same method as in Example 1.

Comparative Example 5

An electrophotographic belt 15 was obtained by being produced in the same method as in Example 1 except that "Fomblin M60" (trade name; manufactured by Solvay Specialty Polymers Japan K.K.) was used as the PFPE, in place of "Fomblin D2" (trade name; manufactured by Solvay Specialty Polymers Japan K.K.), and "Aron GF-420" (trade name; manufactured by Toagosei Co., Ltd.) was used as the dispersing agent, in place of "Aron GF-430" (trade name; manufactured by Toagosei Co., Ltd.), in Example 1. Then, the evaluation was conducted in the same method as in Example 1.

TABLE 2

| | Intermediate transfer belt No. | PFPE Type | PFPE Viscosity at a temperature of 20° C. (mPa · s) | Dispersing agent Type | Dispersing agent Weight average molecular weight Mw | Heating temperature (° C.) at the time of UV treatment |
|---|---|---|---|---|---|---|
| Example 1 | 1 | Fomblin D2 | 150 | Aron GF430 | 31,000 | 50 |
| Example 2 | 2 | Fomblin D2 | 150 | FD420 batched off product | 79,000 | 50 |
| Example 3 | 3 | Fomblin D2 | 150 | Aron GF420 | 20,000 | 50 |
| Example 4 | 4 | Fomblin D2 | 150 | Aron GF430 | 31,000 | 40 |
| Example 5 | 5 | Fomblin D2 | 150 | Aron GF430 | 31,000 | 90 |
| Example 6 | 6 | Fomblin M03 | 52 | Aron GF430 | 31,000 | 50 |
| Example 7 | 7 | Fomblin M30 | 546 | Aron GF430 | 31,000 | 50 |
| Example 8 | 8 | Fomblin D2 | 150 | Aron GF430 | 31,000 | 40 |
| Example 9 | 9 | Fomblin M03 | 52 | Aron GF430 | 31,000 | 90 |
| Example 10 | 10 | Fomblin M03 | 52 | Aron GF430 | 31,000 | 90 |
| Comparative Example 1 | 11 | Fomblin D2 | 150 | FD420 | 110,000 | 50 |
| Comparative Example 2 | 12 | Fluorolink MD700 | 850 | FD420 | 110,000 | 50 |
| Comparative Example 3 | 13 | Fluorolink MD700 | 850 | Aron GF400 | 120,000 | 50 |
| Comparative Example 4 | 14 | Fluorolink MD700 | 850 | Aron GF420 | 20,000 | 50 |
| Comparative Example 5 | 15 | Fomblin M60 | 1020 | Aron GF420 | 20,000 | 50 |

TABLE 3

| | Intermediate transfer belt No. | Surface layer Thickness (μm) | Surface layer Pore volume fraction (%) | Surface Number of pores per 1 μm$^2$ | Surface Pore area ratio (%) | Image evaluation Transferability evaluation Initial stage | After printing of 200k sheets | After printing of 600k sheets |
|---|---|---|---|---|---|---|---|---|
| Example 1 | 1 | 4 | 14.0 | 109 | 23.3 | A | A | A |
| Example 2 | 2 | 4 | 11.5 | 185 | 17.5 | A | A | A |
| Example 3 | 3 | 4 | 18.2 | 45 | 26.3 | A | A | A |
| Example 4 | 4 | 4 | 12.4 | 190 | 18.0 | A | A | A |
| Example 5 | 5 | 4 | 17.6 | 40 | 27.0 | A | A | A |
| Example 6 | 6 | 4 | 17.7 | 92 | 24.2 | A | A | A |
| Example 7 | 7 | 4 | 8.4 | 213 | 13.2 | A | A | A |
| Example 8 | 8 | 4 | 11.1 | 496 | 12.0 | A | A | A |
| Example 9 | 9 | 4 | 24.4 | 80 | 34.8 | A | A | A |
| Example 10 | 10 | 2 | 24.9 | 95 | 32.5 | A | A | A |
| Comparative Example 1 | 11 | 4 | 6.6 | 82 | 16.0 | A | A | B (15%) |
| Comparative Example 2 | 12 | 4 | 1.8 | 75 | 15.0 | A | C (25%) | C (40%) |
| Comparative Example 3 | 13 | 4 | 2.0 | 70 | 14.0 | A | C (35%) | C (45%) |
| Comparative Example 4 | 14 | 4 | 2.7 | 125 | 11.1 | A | C (25%) | C (35%) |
| Comparative Example 5 | 15 | 4 | 2.1 | 135 | 9.5 | A | C (35%) | C (45%) |

In the surface layer according to Comparative Example 1, the pore volume fraction after the PFPE was removed did not reach 8%. This is considered to be because the weight average molecular weight of the dispersing agent which was used for forming the surface layer was as large as 110,000, and accordingly, the domains of the PFPE could not sufficiently agglomerate with each other.

Also, in the surface layers according to Comparative Examples 2 and 3, the pore volume fraction after the PFPE was removed did not reach 8%. This is considered to be because the weight average molecular weight of the dispersing agent which was used for forming the surface layer was as large as 110,000 similarly to that in Comparative Example 1, in addition, the viscosity of the PFPE was high, and accordingly, the domains containing the PFPE could not further agglomerate.

Also, in the surface layers according to Comparative Examples 4 and 5, the pore volume fraction after the PFPE was removed did not reach 8%. This is considered to be because the viscosity of the PFPE was high, and accordingly, the domains containing the PFPE could not agglomerate with each other in a process in which the surface layer was formed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An electrophotographic belt comprising at least a base layer and a surface layer on or above the base layer, the surface layer comprising a binder resin and perfluoropolyether (PFPE);

the surface layer having a thickness of 2 μm or more, wherein when removing the PFPE from the surface layer to obtain a PFPE-removed surface layer, the PFPE-removed surface layer has pores having openings at an outer surface of the PFPE-removed surface layer, and when assuming that the PFPE-removed surface layer is a solid surface layer, a ratio of a total volume of the pores contained in the PFPE-removed surface layer to a volume of the solid-surface layer, i.e. pore volume fraction, is 8 to 25%, and wherein a ratio of a sum of areas of the openings to a unit area (1 $\mu m^2$) of the outer surface of the PFPE-removed surface layer is 10 to 35%, and the number of the openings per unit area (1 $\mu m^2$) of the outer surface of the PFPE-removed surface layer is 10 to 500.

2. The electrophotographic belt according to claim 1, wherein the binder resin is an acrylic resin.

3. The electrophotographic belt according to claim 1, wherein the PFPE has a viscosity of 50 to 550 mPa·s at a temperature of 20° C.

4. The electrophotographic belt according to claim 1, wherein the PFPE has a viscosity of 50 to 200 mPa·s at a temperature of 20° C.

5. The electrophotographic belt according to claim 1, wherein the surface layer comprises a fluorine-containing copolymer, and the copolymer has a weight average molecular weight of 15,000 to 80,000.

6. The electrophotographic belt according to claim 4, wherein the fluorine-containing copolymer is a copolymer of an acrylate or methacrylate having a fluoroalkyl group and a methacrylate macromonomer having polymethyl methacrylate in a side chain.

7. An electrophotographic image forming apparatus comprising an intermediate transfer belt, wherein the intermediate transfer belt is an electrophotographic belt having at least a base layer and a surface layer on or above the base layer, the surface layer comprises a binder resin and perfluoropolyether (PFPE);

the surface layer has a thickness of 2 μm or more;

when removing the PFPE from the surface layer to obtain a PFPE-removed surface layer, the PFPE-removed surface layer has pores having openings at an outer surface thereof, and when assuming that the PFPE-removed surface layer is a solid-surface layer, a ratio of a total volume of the pores contained in the PFPE-removed surface layer to a volume of the solid-surface layer is 8 to 25%; and wherein a ratio of a sum of areas of the openings to a unit area (1 $\mu m^2$) of the outer surface of the PFPE-removed surface layer is 10 to 35%, and the number of the openings per unit area (1 $\mu m^2$) of the outer surface of the PFPE-removed surface layer is 10 to 500.

8. The electrophotographic image forming apparatus according to claim 7, wherein the PFPE has a viscosity of 50 to 550 mPa·s at a temperature of 20° C.

9. The electrophotographic image forming apparatus according to claim 7, wherein the PFPE has a viscosity of 50 to 200 mPa·s at a temperature of 20° C.

10. The electrophotographic image forming apparatus according to claim 7, wherein the surface layer comprises a fluorine-containing copolymer, and the copolymer has a weight average molecular weight of 15,000 to 80,000.

11. The electrophotographic image forming apparatus according to claim 10, wherein the fluorine-containing copolymer is a copolymer of an acrylate or methacrylate having a fluoroalkyl group and a methacrylate macromonomer having polymethyl methacrylate in a side chain.

12. A method for producing an electrophotographic belt, wherein the electrophotographic belt comprises at least a base layer and a surface layer on or above the base layer, the surface layer comprising a binder resin and perfluoropolyether (PFPE);

the surface layer having 2 μm or more;

when removing the PFPE from the surface layer to obtain a PFPE-removed surface layer, the PFPE-removed surface layer having pores having openings at an outer surface thereof, and when assuming that the PFPE-removed surface layer is a solid-surface layer, a ratio of a total volume of the pores contained in the PFPE-removed surface layer to a volume of the solid-surface layer, i.e. pore volume fraction, being 8 to 25%, and a ratio of a sum of areas of the openings to a unit area (1 $\mu m^2$) of the outer surface of the PFPE-removed surface layer being 10 to 35%, and the number of the openings per unit area (1 $\mu m^2$) of the outer surface of the PFPE-removed surface layer being 10 to 500;

the method comprising:

mixing the PFPE, a polymerizable monomer for forming the binder resin, a fluorine-containing copolymer, and a polymerization initiator, to thereby provide a mixture;

forming a layer of the mixture on the base layer; and polymerizing the polymerizable monomer in the layer of the mixture to form the surface layer.

13. The method for producing the electrophotographic belt according to claim 12, wherein the PFPE has a viscosity of 50 to 550 mPa·s at a temperature of 20° C.

14. The method for producing the electrophotographic belt according to claim 12, wherein the PFPE has a viscosity of 50 to 200 mPa·s at a temperature of 20° C.

15. The method for producing the electrophotographic belt according to claim 12, wherein the surface layer comprises a fluorine-containing copolymer, and the copolymer has a weight average molecular weight of 15,000 to 80,000.

16. The method for producing the electrophotographic belt according to claim 15, wherein the fluorine-containing copolymer is a copolymer of an acrylate or methacrylate having a fluoroalkyl group and a methacrylate macromonomer having polymethyl methacrylate in a side chain.

* * * * *